US005326168A

United States Patent [19]

Miura

[11] Patent Number: 5,326,168

[45] Date of Patent: Jul. 5, 1994

[54] STIRRING BLADE UNIT

[75] Inventor: Akio Miura, Iwatsuki, Japan

[73] Assignee: Satake Chemikal Equipment Mfg., Ltd., Moriguchi, Japan

[21] Appl. No.: 103,120

[22] Filed: Aug. 9, 1993

[30] Foreign Application Priority Data

Aug. 7, 1992 [JP] Japan ..... 4-061081

[51] Int. Cl.[5] ..... B01F 13/00

[52] U.S. Cl. ..... 366/343; 416/223 R; 416/231 A; 416/228

[58] Field of Search ..... 366/343, 325, 330, 329, 366/327, 326; 416/223 R, 228, 231 A

[56] References Cited

U.S. PATENT DOCUMENTS 4,722,608 2/1988 Salzman ..... 366/343
5,152,606 10/1992 Borraccia ..... 366/343
5,215,441 6/1993 Evans ..... 416/223 R

*Primary Examiner*—Robert W. Jenkins
*Attorney, Agent, or Firm*—Oblon, Spivak, McClelland, Maier & Neustadt

[57] ABSTRACT

A stirring blade unit includes a plurality of main blade bodies radially projected from the outer periphery of a boss and auxiliary blade bodies respectively provided at tip portions of the main blade bodies in a manner so as to be downwardly projected. With this arrangement, it is possible to prevent swinging of the rotational shaft, the fabrication and mounting of the auxiliary blade bodies is made easier, material costs are reduced, and the mounting space required is reduced.

3 Claims, 1 Drawing Sheet

STIRRING BLADE UNIT

BACKGROUND OF THE INVENTION

1. Field of the Invention

The present invention relates to a stirring blade unit used for stirring a liquid or the like in the food industry and science industry.

2. Discussion of the Background

The conventional stirring blade unit has the following inconvenience: namely, in the case of stirring a liquid while supplying or discharging the liquid into or from a vessel, there occurs swinging of the blade bodies in the stirring blade unit resulting in an eccentric rotation of the rotational shaft. To prevent this outward swinging by the blade bodies and eccentric rotation of the rotational shaft, there has been disclosed a stirring blade unit such as shown in FIG. 4, wherein a cylindrical stabilizer ring b is concentrically provided under blade bodies a.

However, since the above-described stabilizer ring b is formed in a cylindrical shape and must be concentrically mounted under the blade bodies a, there arise such disadvantages that its fabrication is made difficult, a large amount of the material is required and the cost is thus increased. Moreover, a large space is taken up within the vessel.

SUMMARY OF THE INVENTION

Accordingly, an object of the present invention is to prevent swinging by a rotational shaft of a stirring blade unit even in the case of stirring a liquid while supplying or discharging the liquid into or from a vessel.

Another object of the present invention is to simplify the structure of a stirring blade unit, to make fabrication and the mounting thereof easy to accomplish, and to reduce the mounting space.

To achieve the above objects, according to the present invention, there is provided a stirring blade unit comprising a plurality of main blade bodies radially projected from the outer periphery of a boss, and auxiliary blade bodies respectively provided at the leading edge portions of the main blade bodies in a manner so as to be downwardly projected.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
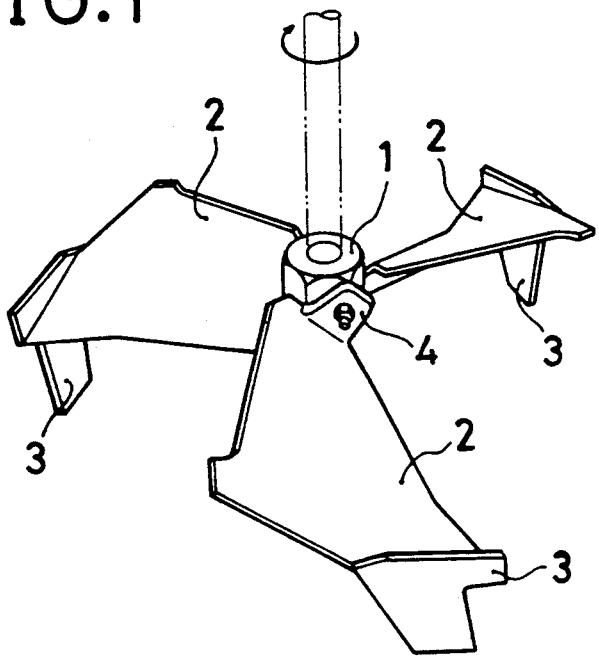
FIG. 1 is a perspective view of one embodiment according to the present invention.
Figure 2:
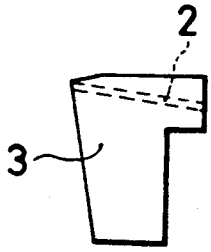
FIG. 2 is a front view of the main part of the embodiment.
Figure 3:
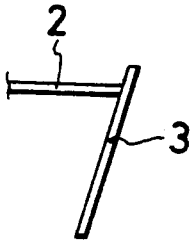
FIG. 3 is a side view of the main part of FIG. 2.
Figure 4:
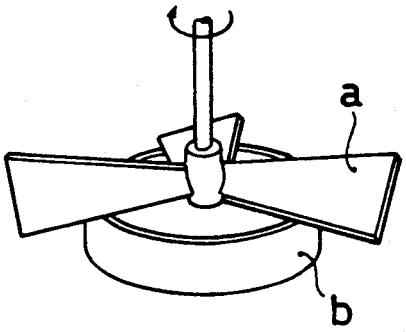
FIG.4 (PRIOR ART)
FIG. 4 is a perspective view of an example according to a prior art blade assembly.

One embodiment of the present invention will now be described with reference to FIGS. 1 to 3.

Reference numeral 1 indicates a boss wherein main blade bodies 2 are radially fixed at the base portions thereof around the outer periphery of the boss 1 by means of bolts 4. Each of these main blade bodies 2 is formed so as to be gradually extended in terms of the width or chord from the trailing edge portion to the leading edge portion thereof.

Reference numeral 3 indicate auxiliary blade bodies, each of which has a flat plate formed of an inverted L-shape. The auxiliary blade bodies 3 are respectively fixed at the tip portions of the main blade bodies 2 in a manner so as to be projected downwardly.

When the stirring blade unit is rotated in a liquid within a vessel, there are generated flows of the liquid inside and outside the auxiliary blade bodies 3. This prevents radial swinging of the auxiliary blade bodies 3 due to the effects of the pressures applied on the inner surface and the outer surface of the auxiliary blade bodies 3 owing to the flows generated inside and outside thereof and the resistance load of the liquid applied on the auxiliary blade bodies 3. Accordingly, even without the conventional stabilizer ring, it is possible to prevent swinging of the blade bodies and the rotational shaft.

Further, since each main blade body 2 is formed of a shape so as to gradually increase in width or chord length from the trailing edge portion to the leading edge portion, the contact area with the liquid on the tip portion side of the main blade body 2 with a high rotational speed is made larger than that at the base portion side of the main blade body 2 with a low rotational speed, which makes it possible to increase the discharge flow rate by the stirring blade unit.

Also, each auxiliary blade body 3 is fixed in such a manner that the lower portion thereof is slanted inwardly. Thus the lower portion is closer to the boss than an upper portion. As a result, especially in the case that stirring is conducted while the liquid is discharged from the vessel, the liquid is gradually moved in a slanted and downward manner along the auxiliary blade bodies 3, thus making it possible to smoothly discharge the liquid.

In addition, the shape of the auxiliary blade body 3 may be formed of an arbitrary shape, for example, a rectangular shape, an inverted truncated conical shape or the like.

Obviously, numerous modifications and variations of the present invention are possible in light of the above teachings. It is therefore to be understood that within the scope of the appended claims, the invention may be practiced otherwise than as specifically described herein.

What is claimed is:

1. A stirring blade unit, comprising:

a boss;

a plurality of main blade bodies radially projected from an outer periphery of said boss; and auxiliary blade bodies respectively provided at tip portion of said main blade bodies in a manner so as to be downwardly projected wherein each of said auxiliary blade bodies is fixed to the main blade bodies in such a manner that a lower portion of the auxiliary blade body is respectively below the main blade bodies and is slanted towards said boss such that said lower portion is positioned closer to said boss than an upper portion of the auxiliary blade body.

2. A stirring blade unit according to claim 1, wherein each of said main blade bodies has a gradually increased chord line from the base portion to the tip portion thereof.

3. A stirring blade unit according to claim 1, wherein at least one of said auxiliary blade bodies is substantially flat.

* * * * *